United States Patent [19]

Sono

[11] 4,306,241

[45] Dec. 15, 1981

[54] ANTENNA MOUNTING STRUCTURE FOR AUTOMOTIVE WINDSHIELDS

[75] Inventor: Isao Sono, Yokohama, Japan

[73] Assignee: Nissan Motor Company, Limited, Yokohama, Japan

[21] Appl. No.: 147,171

[22] Filed: May 6, 1980

[30] Foreign Application Priority Data

May 31, 1979 [JP] Japan ..... 54-73691[U]

[51] Int. Cl.[3] ..... H01Q 1/32

[52] U.S. Cl. ..... 343/713; 343/715

[58] Field of Search ..... 343/713, 715, 909, 720, 343/721

[56] References Cited

U.S. PATENT DOCUMENTS

| | | | |
|---|---|---|---|
| 1,715,952 | 6/1929 | Rostron | 343/720 |
| 2,161,777 | 6/1939 | Sarnes | 343/900 |
| 3,945,014 | 3/1976 | Kunert et al. | 343/713 |
| 4,089,817 | 5/1978 | Kirkendall | 343/713 |

FOREIGN PATENT DOCUMENTS

| | | | |
|---|---|---|---|
| 2538290 | 4/1976 | Fed. Rep. of Germany | 343/713 |
| 1127511 | 12/1956 | France | 343/713 |

*Primary Examiner*—Eli Lieberman

[57] ABSTRACT

A structure is disclosed for mounting an antenna on the window glass of an automotive vehicle. The structure has a supporting member secured in a through-hole formed near the upper and center position of the window glass and a connection member for connecting with the antenna, the connection member pivotably mounted on the supporting member.

2 Claims, 7 Drawing Figures

ANTENNA MOUNTING STRUCTURE FOR AUTOMOTIVE WINDSHIELDS

BACKGROUND OF THE INVENTION

This invention relates to a structure for mounting an antenna on the window glass of an automotive vehicle.

An antenna for automotive vehicle radio devices has been mounted to an automotive vehicle in an upright position with its base portion inserted through a hole formed in the roof panel and secured thereto by means of a nut. Alternatively, the antenna has been mounted to an automotive vehicle in an oblique position with its body secured along the outside of the wind shield pillar.

However, the former structure creates rust around the through a tunnelled automatic car washer. The latter structure generates unpleasant whistling noises through the narrow space between the wind shield pillar and the antenna body, especially when the vehicle is running at high speeds.

Furthermore, with the conventional structure to mount an inside rear view mirror to the front roof frame through a stay, the stay is exposed to view and provides a worse appearance. With an alternative structure to bond an inside rear view mirror on the window glass, there is the possibility of the mirror from coming off.

SUMMARY OF THE INVENTION

It is therefore an object of the present invention to provide an antenna mounting structure for an automotive vehicle, which makes free from generations of rust at the vicinity of an antenna mounted thereon, and generations of whistling noises through a narrow space between the antenna and the body.

Another object of the present invention is to provide an antenna mounting structure for an automotive vehicle, which can be washed by a tunnelled automatic car washer without the danger of breakage of the antenna.

A further object of the present invention is to provide an antenna mounting structure for an automotive vehicle, which has a base member on which an inside rear view mirror can be mounted within the vehicle compartment so as to provide a good appearance of the inside rear view mirror.

Other objects, features and advantages of the present invention will be apparent from the following description when taken in conjunction with the accompanying drawings.

In accordance with the present invention, there is provided an antenna mounting structure in a through hole bored at an upper and central position of a window glass such as a front and/or rear window glass of a vehicle body. The antenna is pivotably secured at the antenna mounting structure so as to hold the antenna along the window glass during washing the vehicle body in a tunnelled automatic car washer. Accordingly, it makes free from the disadvantages shown in the prior arts such as generations of rust at the vicinity of a bored hole for mounting the antenna, generations of whistling noises through a narrow space between the antenna and the vehicle body, and a danger of breakage of the antenna during washing the vehicle body in a tunnelled automatic car washer.

Further, the antenna mounting structure may be utilized for mounting a stay of an inside rear view mirror so as to hide the stay from the view of passenger.

BRIEF DESCRIPTION OF THE DRAWINGS

The accompanying drawings, however, should not be taken an limiting the present invention in any way, but are given for purposes of illustration only. In the drawings, like parts are denoted by like reference numerals in the several figures, and.

DESCRIPTION OF THE PREFERRED EMBODIMENTS

Figure 1:
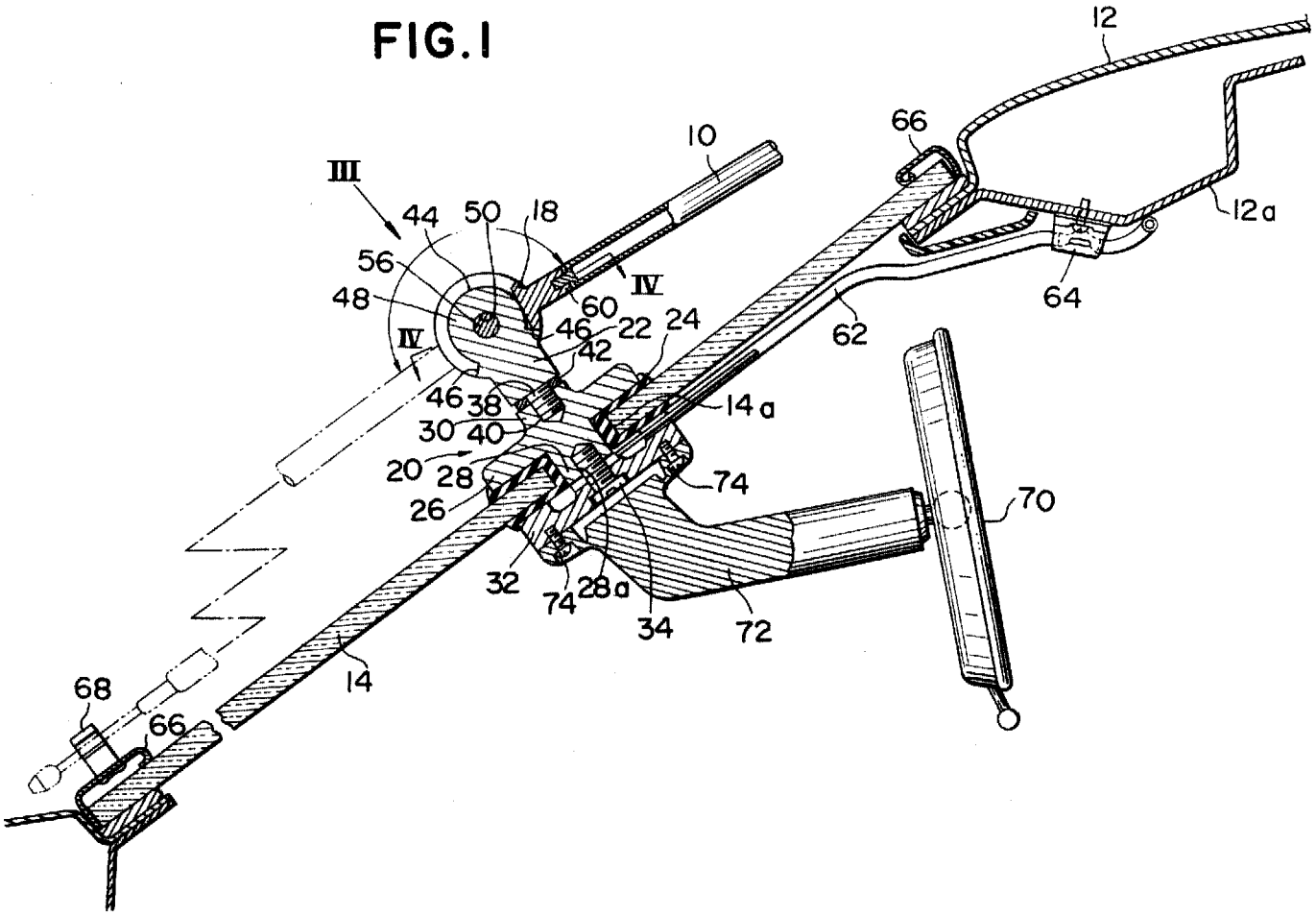
FIG. 1 is sectional view of one embodiment of an antenna mounting structure of the present invention.
Figure 2:
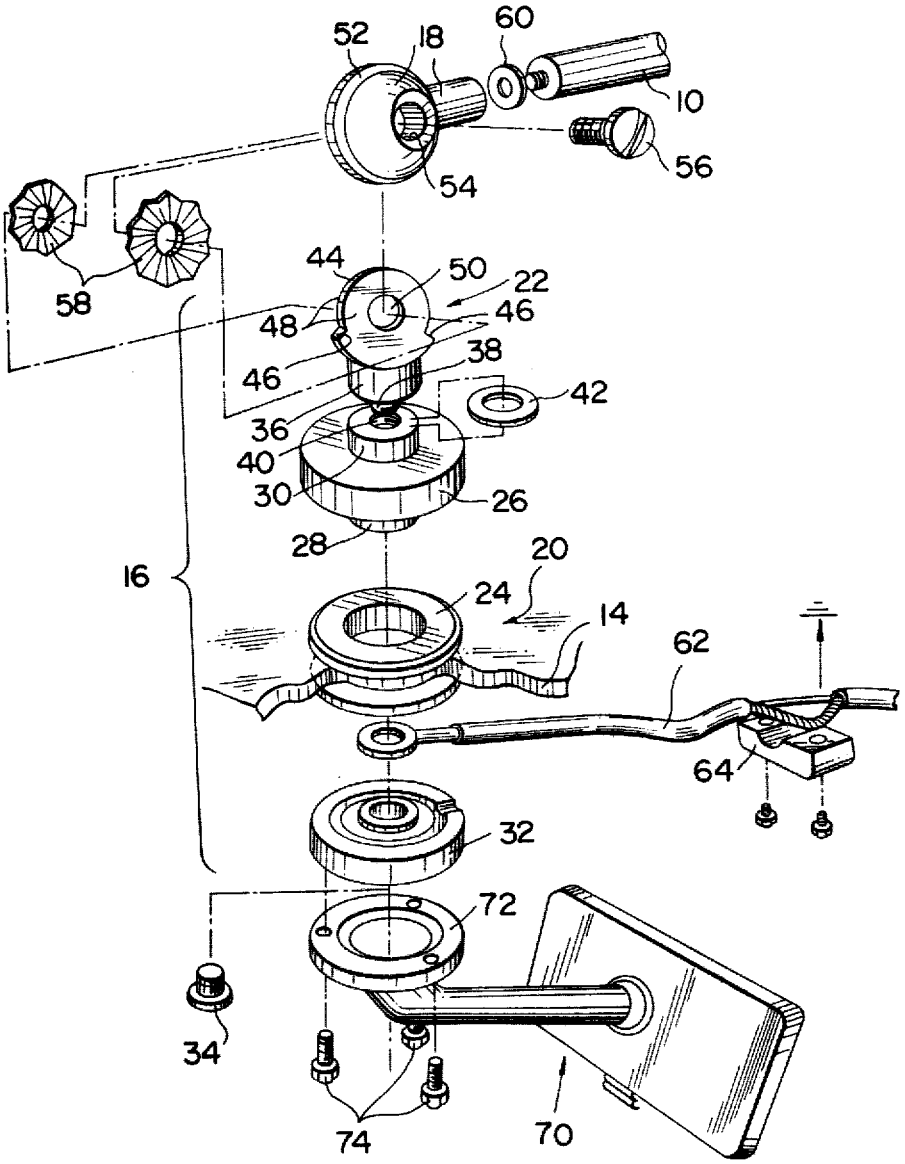
FIG. 2 is an exploded perspective view of the antenna mounting structure of FIG. 1.

Referring now to FIGS. 1 and 2, there is illustrated a structure, embodying the present invention, for mounting an antenna 10 on an automotive vehicle body. In the figures, the numeral 12 designates an automotive vehicle roof panel and the numeral 14 an automotive vehicle front window glass formed at its upper and central position with a through-hole 14. The antenna mounting structure comprises a support member 16 secured in the through-hole 14*a* of the front glss window 14, and a connection member 18 having its one end mounted for pivotal movement and the other end for connection to the antenna 10. The support member 16 includes a base 20 and a holder 22 for supporting the connection member 18. The base 20 includes a sealing member 24, which has sealing and cushioning functions, fitted in the hole 14*a* of the front window glass 14, an upper member 26 having bosses 28 and 30 on the opposite surfaces thereof with the lower boss 28 received in the sealing member 24, and a lower member 32 secured on the lower surface of the sealing member 24 by a bolt 34 threadedly engaged in the threaded hole 28*a* formed in the lower boss 28. The connection member holder 22 includes a leg portion 36 having on its lower surface a threaded projection 38 in detachably threaded engagement with the threaded hole 40 formed in the upper boss 30 through a washer 42. The holder 24 has a curved upper surface 44 in sliding contact with the connection member 22, stoppers 46 at the opposite ends of the curved upper surface 44, and side surface 48 having a center hole 50.

Figure 3:
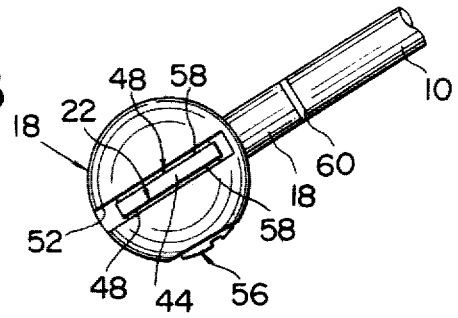
FIG. 3 is a fragmentary schematic view of the structure of FIG. 1 as viewed from the direction indicated by the arrow III of FIG. 1.
Figure 4:
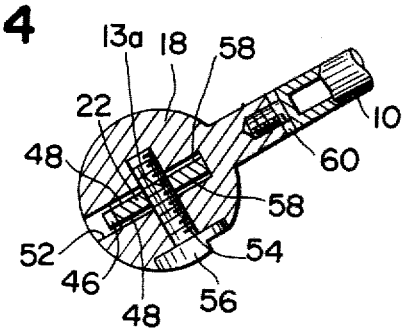
FIG. 4 is a fragmentary sectional view of the structure of FIG. 1 taken along the line IV—IV of FIG. 1.

As shown in FIGS. 3 and 4, the connection member 18 includes a spherical member having a groove 52 in which the upper portion of the connection member holder 22 is insetted, and a threaded hole 54 threadedly engaged with a bolt 56 so that the connection member 18 is pivotably connected to the holder 22 through two pieces of wave washer 58.

Figure 5:
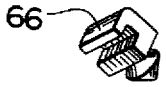
FIG. 5 is a perspective view of the clip of the structure of FIG. 1.
Figure 7:
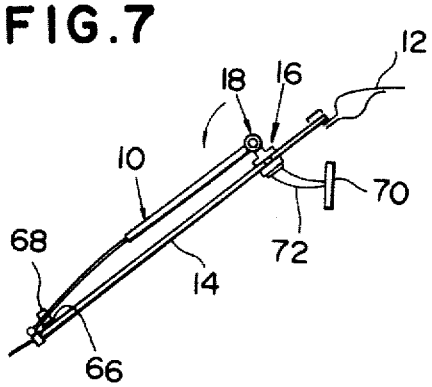

The antenna 10 is threadedly engaged to the connection member 18 through a washer 60. The numeral 62 designates an electric wire for connection between the antenna 10 and a battery (not shown). A holder 64 is provided for fixing the wire 62 to the inner surface 12*a* of the roof panel 12. The window glass 14 is attached to the vehicle body through a window moul 66. Mounted at a lower positions of the window moul 66 is a clip 68 which is shaped, as shown in FIG. 5, for attachably holding the top end of the antenna 10 when the antenna 10 is rotated to a position as shown in FIG. 7. This eliminates the possibility of breakage of the antenna while the vehicle body is being washed in the automatic car washer.

The numeral 70 designates an inside rear-view mirror having a stay 72 secured to the lower member 32 of the base 20 by bolts 74. As best shown in FIG. 3, the stay 72 is hiden behind the inside rear-view mirror so that the stay 72 is not exposed to the view from passengers.

Figure 6:
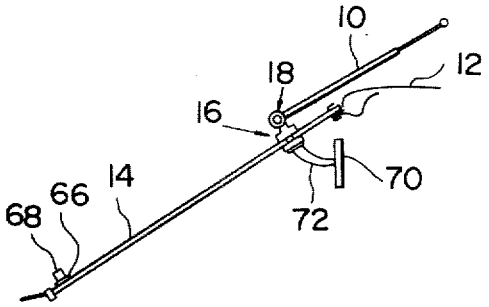
FIG. 6 is a schematic sectional view of the structure of FIG. 1, with the antenna being in its normal using position; and, FIG. 7 is a schematic sectional view of the structure FIG. 1, with the antenna being in its rest position.

It will be understood in view of the foregoing that when the antenna 10 secured to the antenna mounting structure of the present invention is in its normal using position as shown in FIG. 6, the generation of whistling noises through the narrow space between the antenna 10 and the vehicle body can be prohibited. Further, since the antenna mounting structure of the present invention is mounted at the window glass such as the front window glass 14, it is possible to make free from the generation of rust at the vicinity of the antenna mounted position while occurs in the prior arts. When the vehicle body is washed in the automatic car washer, the antenna 10 can be manually pivoted downwards and maintained at the position as shown in FIG. 7 and the dotted line in FIG. 1 with its held in the clip 68. This make it free from breaking off by the automatic car washer.

In addition, when the antenna mounting structure is provided at the front window glass 14 as shown in this embodiment, the stay 72 of the inside rear-view mirror 70 may be secured to the lower member 32 of the antenna mounting structure from the inside of the window glass 12 so that the stay 72 can be mounted behind the inside rear-view mirror 70. That is, the stay 72 is not exposed to the view from the passenger, thereby providing a better appearance of the passenger compartment.

The present invention has been described above in terms of a preferred embodiment and with reference to the appended drawings, but neither of these is to be taken an limitative of the scope of the present invention which is to be determined by the appended claims. Various modifications of the embodiment within the scope of the present invention will be clear to those skilled in the art. For example, the antenna 12 may be mounted at a rear window glass in the same manner as described in connections with this preferred embodiment. Further, the antenna supporting member 16 and the connection member 18 may be replaced with any suitable ball-joint, slidable supporting device so as to slide the antenna 10 upwards and downwards. The antenna supporting member 16 has to be mounted at the upper portion of the window glass so as to avoid an obstruct in the view from the driver.

What is claimed is:

1. A structure for mounting a rod-shaped antenna and a rear view mirror on a windshield of an automotive vehicle, comprising:

(a) a through-hole in said windshield;

(b) an outer base member placed on the outer surface of said windshield to cover said through-hole;

(c) an inner base member placed on the inner surface of said windshield in opposed and facing relation to said outer base member, said inner base member having said rear view mirror secured on its inner surface;

(d) means extending through said through-hole for securing said outer and inner base members on the opposite surfaces of said windshield; and (e) a support member secured on the outer surface of said outer base member for supporting said antenna.

2. A structure according to claim 1, wherein said support member comprises a base secured on the outer surface of said outer base member, and an arm mechanically connected with said antenna, said arm being pivotally mounted to said base for permitting said antenna to turn in opposite directions.

* * * * *